US008137143B2

(12) United States Patent
McSweyn et al.

(10) Patent No.: US 8,137,143 B2
(45) Date of Patent: Mar. 20, 2012

(54) BATTERY CLAMP

(75) Inventors: Christopher M. McSweyn, Oxnard, CA (US); Kevin Trejo, Oak Hills, CA (US)

(73) Assignee: Scosche Industries, Inc., Oxnard, CA (US)

( * ) Notice: Subject to any disclaimer, the term of this patent is extended or adjusted under 35 U.S.C. 154(b) by 97 days.

(21) Appl. No.: 12/717,533

(22) Filed: Mar. 4, 2010

(65) Prior Publication Data

US 2011/0217884 A1 Sep. 8, 2011

(51) Int. Cl.
*H01R 4/50* (2006.01)

(52) U.S. Cl. ..... 439/770; 439/957

(58) Field of Classification Search ..... 439/754, 439/763, 774, 770, 957
See application file for complete search history.

(56) References Cited

U.S. PATENT DOCUMENTS

| | | | | | |
|---|---|---|---|---|---|
| 1,507,936 | A | * | 9/1924 | Schmitt | 439/771 |
| 1,742,571 | A | * | 1/1930 | Berg | 439/770 |
| 2,121,629 | A | * | 6/1938 | Gladstone | 439/200 |
| 2,533,763 | A | * | 12/1950 | Cacciotti | 439/764 |
| 3,005,181 | A | * | 10/1961 | Ament | 439/773 |
| 3,783,439 | A | * | 1/1974 | Valentino | 439/627 |
| 3,990,769 | A | * | 11/1976 | Bureau | 439/770 |
| 4,342,497 | A | * | 8/1982 | Morrison | 439/522 |
| 4,372,636 | A | * | 2/1983 | Dufresne | 439/726 |
| 4,560,229 | A | * | 12/1985 | Benton | 439/754 |
| 4,560,230 | A | * | 12/1985 | Inglis | 439/890 |
| 4,576,430 | A | * | 3/1986 | Dufresne | 439/429 |
| 4,740,178 | A | * | 4/1988 | Badenhorst et al. | 439/758 |
| 4,797,111 | A | * | 1/1989 | Ackmann | 439/755 |
| 4,913,981 | A | * | 4/1990 | Hynes et al. | 429/1 |
| 4,932,896 | A | * | 6/1990 | Julian | 439/504 |
| 4,938,706 | A | * | 7/1990 | Sykes | 439/202 |
| 5,094,635 | A | * | 3/1992 | Thompson et al. | 439/755 |
| 5,171,169 | A | | 12/1992 | Butcher et al. | |
| 5,277,629 | A | * | 1/1994 | Rissik et al. | 439/770 |
| 5,664,971 | A | * | 9/1997 | Coy | 439/811 |
| 5,921,809 | A | * | 7/1999 | Fink | 439/504 |
| 6,147,471 | A | * | 11/2000 | Hunter | 320/105 |
| 6,165,020 | A | * | 12/2000 | Cheng et al. | 439/620.31 |
| 6,203,383 | B1 | | 3/2001 | Iby et al. | |
| 6,459,233 | B1 | * | 10/2002 | Liang | 320/105 |
| 6,695,652 | B1 | | 2/2004 | Reardon, Jr. | |

(Continued)

OTHER PUBLICATIONS

International Searching Authority, International Search Report and Written Opinion of the International Application No. PCT/US2011/027030, dated May 19, 2011.

*Primary Examiner* — Neil Abrams

(57) ABSTRACT

A battery clamp assembly connecting an electrical wire to a battery terminal includes a body having a clamp cavity and at least one connection socket for receiving the electrical wire, a clamp device positioned in the clamp cavity, a compression wedge positioned in the clamp cavity, and a fastening member that engages the compression wedge to couple the clamp and the compression wedge to the body. A polarity marker may be plugged into a terminal aperture provided in an access cover to permit visual identification of the terminal connection. A method of completing an electrical circuit between a component and a power source may include coupling a battery clamp assembly to the power source, connecting the electrical wire to the battery clamp assembly by securing the electrical wire into the connection using the compression screw, and tightening the fastening member which engages the compression wedge to close the clamp. A post to be used for attachment of a jumper cable may be mounted to the battery clamp.

17 Claims, 10 Drawing Sheets

U.S. PATENT DOCUMENTS 6,932,650 B1 * 8/2005 Freitag ..... 439/620.26
6,971,925 B1 12/2005 Orange
7,351,119 B2 4/2008 Mac Donald
7,540,791 B1 * 6/2009 Dharani ..... 439/772
7,578,255 B2 8/2009 Pittenger
2003/0203681 A1 * 10/2003 Liang ..... 439/768
2005/0151115 A1 7/2005 Hampden-Smith et al.
2006/0003627 A1 * 1/2006 Freitag ..... 439/504
2007/0049113 A1 3/2007 Rodrigues et al.
2011/0217884 A1 * 9/2011 McSweyn et al. ..... 439/772

* cited by examiner

BATTERY CLAMP

BACKGROUND

1. Field

The present disclosure relates to a battery clamp assembly and, more particularly, to a battery power distribution clamp.

2. Description of Related Art

Battery terminal clamps conventionally connect components that draw an electrical load from a vehicle battery through a ring clamp, for example, where a bolt is used to tighten the ring clamp around a battery terminal post. The battery terminal clamp typically has a socket at a tail end of the ring clamp. A power cable is inserted into the socket, and the socket is crimped, for example, to securely hold the power cable in connection with the battery terminal clamp.

More recently, with the increased use of audio, video and navigational components in vehicles, for example, a need for increased power distribution to a variety of often interchangeable vehicle components exists. These various components may have different connectivity requirements, and the variety of possible configurations in the market today requires a highly efficient and integrated power distribution system. Accordingly, power distribution terminal clamps have been developed that connect to a battery terminal post and provide a variety of means for connecting a variety of power cables to a single clamp. However, these power distribution clamps are often inconvenient and difficult to use, requiring complete removal from the terminal post, for example, to make adjustments and/or each time a component is exchanged, repaired, or added. Removal of the power distribution clamp from the battery terminal post typically requires side or rear access to a tightening bolt, which can be difficult in the cramped confines of most engine compartments.

There exists a need for an ergonomically designed, efficient power distribution clamp assembly that provides easy access to the clamping mechanism for coupling the clamp to a battery terminal post, for example, as well as the ability to quickly and easily connect and disconnect multiple various gauge wires in one unit that provides a reliable electrical connection of high integrity.

SUMMARY

In one aspect of the disclosure, a battery clamp assembly connecting an electrical wire to a battery terminal includes a body having a clamp cavity and at least one connection socket for receiving the electrical wire, a floating clamp positioned in the clamp cavity, a compression wedge positioned in the clamp cavity, and a fastening member that engages the compression wedge to couple the floating clamp and the compression wedge to the body. The body of the battery clamp assembly may include a clamp mount that extends into the clamp cavity and aligns with the floating c-clamp to form a clamping cylinder. A vertical movement of the compression wedge may translate into a horizontal movement of the floating clamp.

Another feature in accordance with aspects of the present invention includes providing an access cover that slidably mates to an upper surface of the body of the battery clamp assembly, wherein the upper surface has left and right contoured shelves that protrude from the upper surface to form a keyed slot in the body of the battery clamp assembly. The access cover has a keyed end that slidably seats in the keyed slot when the access cover is coupled to the battery clamp assembly. A polarity marker may be plugged into a terminal aperture provided in the access cover to permit visual identification, for example, of the terminal connection.

In yet another aspect of the disclosure, an insert may slidably mount in the connection socket in the body of the battery clamp assembly so that the insert reduces the size of the connection socket for receiving a different gauge electrical wire. A compression screw may be provided wherein the compression screw extends through the body into the connection socket for securing the electrical wire to the battery clamp assembly.

In another aspect of the disclosure, a method of completing an electrical circuit between a component and a power source may include coupling a battery clamp assembly to the power source, connecting the electrical wire to the battery clamp assembly by securing the electrical wire into the connection using the compression screw, and tightening the fastening member which engages the compression wedge to close the clamp and provide a secure electrical connection between the battery clamp assembly and the power source.

It is understood that other aspects of a battery clamp assembly will become readily apparent to those skilled in the art from the following detailed description, wherein it is shown and described only exemplary configurations of a battery clamp. As will be realized, the invention includes other and different aspects of a battery clamp assembly and the various details presented throughout this disclosure are capable of modification in various other respects, all without departing from the spirit and scope of the invention. Accordingly, the drawings and the detailed description are to be regarded as illustrative in nature and not as restrictive.

DETAILED DESCRIPTION

Figure 1:
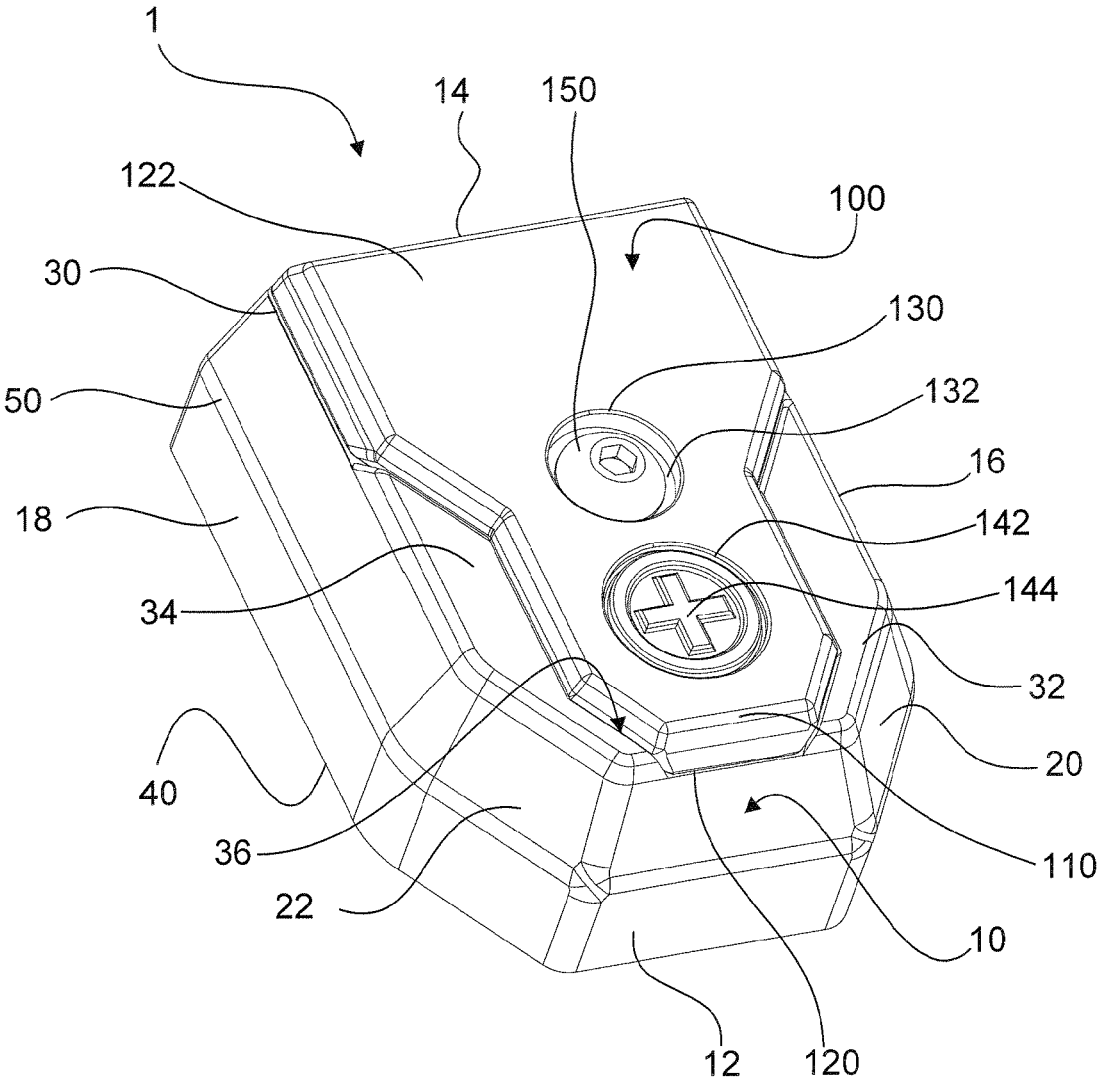
FIG. 1 is a perspective view of a battery clamp assembly, in accordance with aspects of the present invention.

The present invention is described more fully hereinafter with reference to the accompanying drawings, in which various aspects of a battery clamp assembly are shown. This invention, however, may be embodied in many different forms and should not be construed as limited by the various aspects of the battery clamp assembly presented herein. The detailed description of the battery clamp assembly is provided below so that this disclosure will be thorough and complete, and will fully convey the scope of the present invention to those skilled in the art.

The detailed description may include specific details for illustrating various aspects of a battery clamp. However, it will be apparent to those skilled in the art that the invention may be practiced without these specific details. In some instances, well known elements may be shown in block diagram form, or omitted, to avoid obscuring the inventive concepts presented throughout this disclosure.

Various aspects of a battery clamp assembly may be illustrated by describing components that are coupled together. As used herein, the term "coupled" is used to indicate either a direct connection between two components or, where appropriate, an indirect connection to one another through intervening or intermediate components. In contrast, when a component referred to as being "directly coupled" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of an apparatus in addition to the orientation depicted in the drawings. By way of example, if an apparatus in the drawings is turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of a battery clamp assembly may be illustrated with reference to one or more exemplary embodiments. As used herein, the term "exemplary" means "serving as an example, instance, or illustration," and should not necessarily be construed as preferred or advantageous over other embodiments of a battery clamp assembly disclosed herein.

Figure 2:
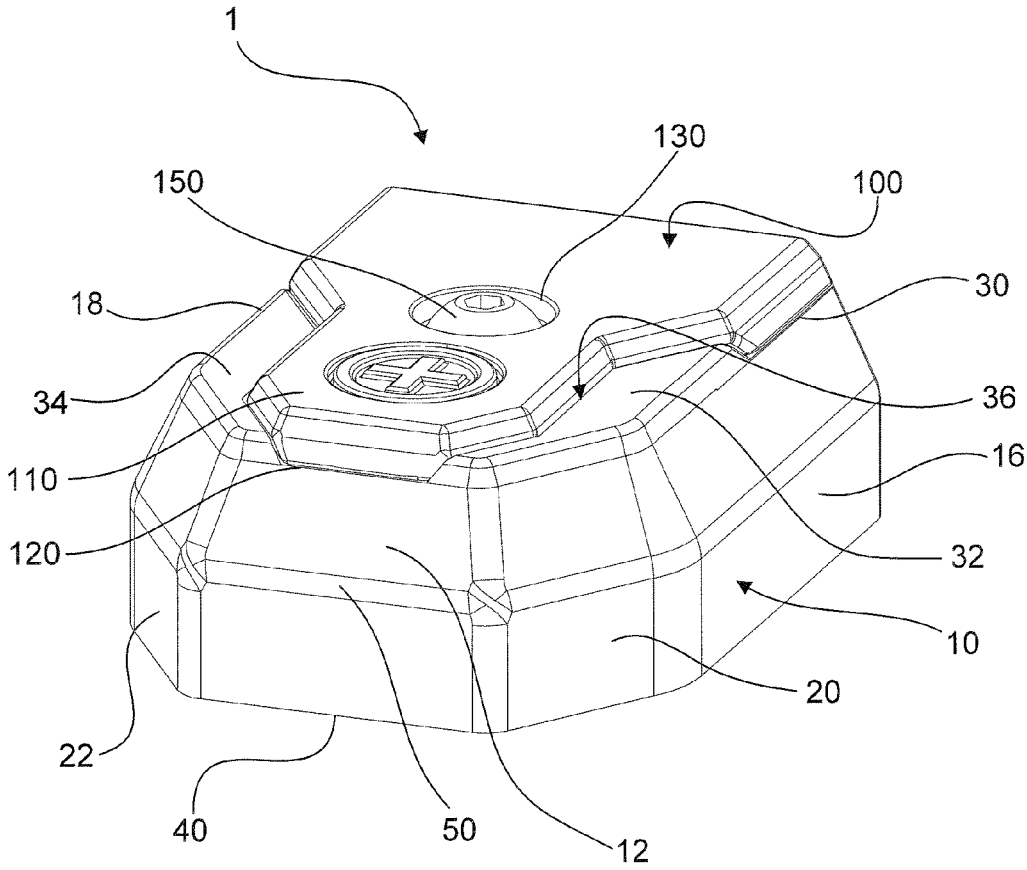
FIG. 2 is another perspective view of the battery clamp assembly, in accordance with aspects of the present invention.

FIGS. 1 and 2 are perspective views of a battery clamp assembly 1 in accordance with aspects of the present invention. The battery clamp assembly 1 is compact, ergonomically designed for ease of use, and built for performance. The battery clamp assembly 1 includes a body 10 and an access cover 100. The body 10 may be generally rectangular in shape, for example, including a terminal end surface 12, an insertion end surface 14, a left side 16 and a right side 18 that run parallel in a longitudinal direction from the insertion end surface 14 and connect to the terminal end surface 12 by way of a left corner 20 and a right corner 22, respectively. As shown in FIGS. 1 and 2, the terminal end surface 12 may be laterally shorter in dimension than the insertion end surface 14. The body 10 includes an upper surface 30 and a lower surface 40.

As shown in FIGS. 1 and 2, the body 10 may be formed with a tiered perimeter so that each of the terminal end surface 12, the insertion end surface 14, the left and right sides, 16 and 18, and the left and right corners 20 and 22 are divided at a bevel edge 50 into an upper body portion and a lower body portion. The upper body portion of the tiered perimeter of the body 10 may be beveled to recede from the bevel edge 50 towards the upper surface 30 so that a planar area encompassed by a perimeter of the upper surface 30 is less than a planar area encompassed by a perimeter of the lower surface 40.

The upper surface 30 may be formed with left and right contoured shelves, 32 and 34, that protrude from the perimeter of the upper surface 30 and extend from the terminal end surface 12 to points near a middle portion of the left and right sides, 16 and 18, respectively. The left and right contoured shelves, 32 and 34, work together to form a keyed slot 36 (see also FIG. 6) that is narrower toward the terminal end surface 12 for receiving a similarly contoured keyed end 110 of the access cover 100. The access cover 100 may thus be easily positioned by placing a flat mating surface 120 of the access cover 100 into contact with the upper surface 30 of the body 10 and sliding the keyed end 110 of the access cover 100 into the keyed slot 36 of the upper surface 30 until the access cover 100 is seated firmly against the left and right contoured shelves, 32 and 34. While being ergonomically efficient, the arrangement of the keyed slot 36 and the keyed end 110 also ensures that a cover fastening aperture 130 and a terminal aperture 140 (see FIGS. 4 and 5) in the access cover 100 respectively align with a body fastening aperture 38 (see FIG. 6) and a battery terminal (not shown), for example.

Figure 3:
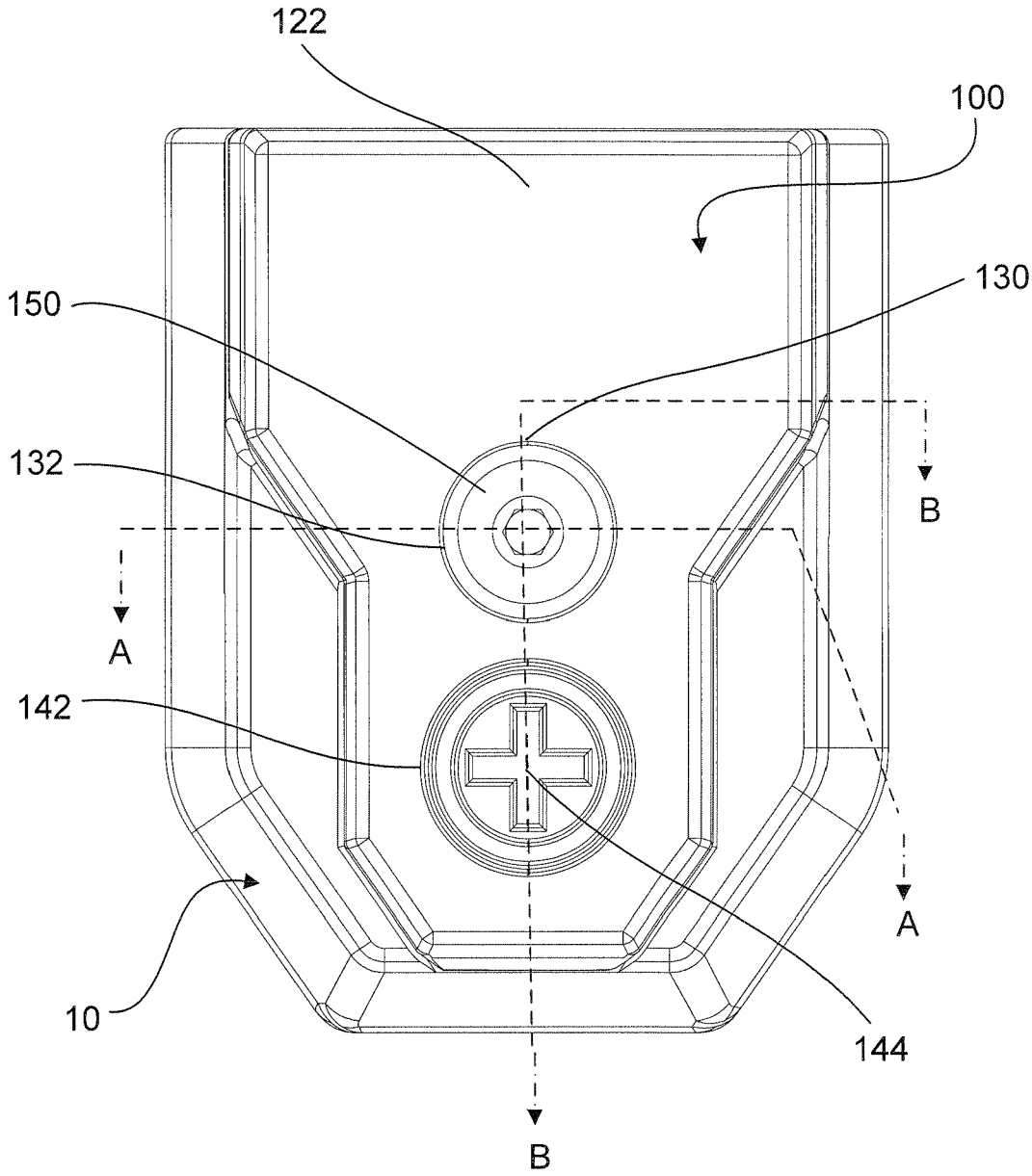
FIG. 3 is a top view of the battery clamp assembly, in accordance with aspects of the present invention.

As shown in FIGS. 1 and 3, the cover fastening aperture 130 may have a retaining flange 132 countersunk into an upper surface 122 of the access cover 100 for providing a bearing surface when securing the access cover 100 to the body 10. A fastening device 150, such as an externally threaded bolt with a hex head, for example, may be used to secure the access cover 100 against the body 10. Countersinking the retaining flange 132 allows additional clearance above the battery clamp assembly 1 when the fastening device 150 is secured. The additional clearance is important when using a protective cover for the battery clamp assembly 1 and permits a low profile configuration for use of the battery clamp assembly 1 in the cramped confines of most engine compartments, for example.

A concentric recessed portion 142 may be formed about the periphery of the terminal aperture 140 in the upper surface 122 of the access cover 100. A disc-shaped polarity marker 144, for example, may be formed with a plug (not shown) centrally protruding from a lower main surface (not shown). The plug may be press fit into the terminal aperture 140, which may be threaded, so that the disc-shaped polarity marker 144 is situated in the recessed portion 142 with an upper main surface substantially aligned in a plane with the upper surface 122 of the access cover 100. Multiple polarity markers 144 may thus be interchangeably used to signify whether the battery clamp assembly 1 is coupled to a positive or a negative terminal of a vehicle battery. For example, the polarity marker 144 may be red, or have a plus (+) sign printed or integrated onto an upper main surface, to signify that the battery clamp assembly 1 is coupled to the positive terminal. Similarly, the polarity marker 144 may be black, or have a negative (−) sign printed or integrated onto the upper main surface, to indicate that the battery clamp assembly 1 is coupled to the negative, or ground, terminal.

Figure 4:
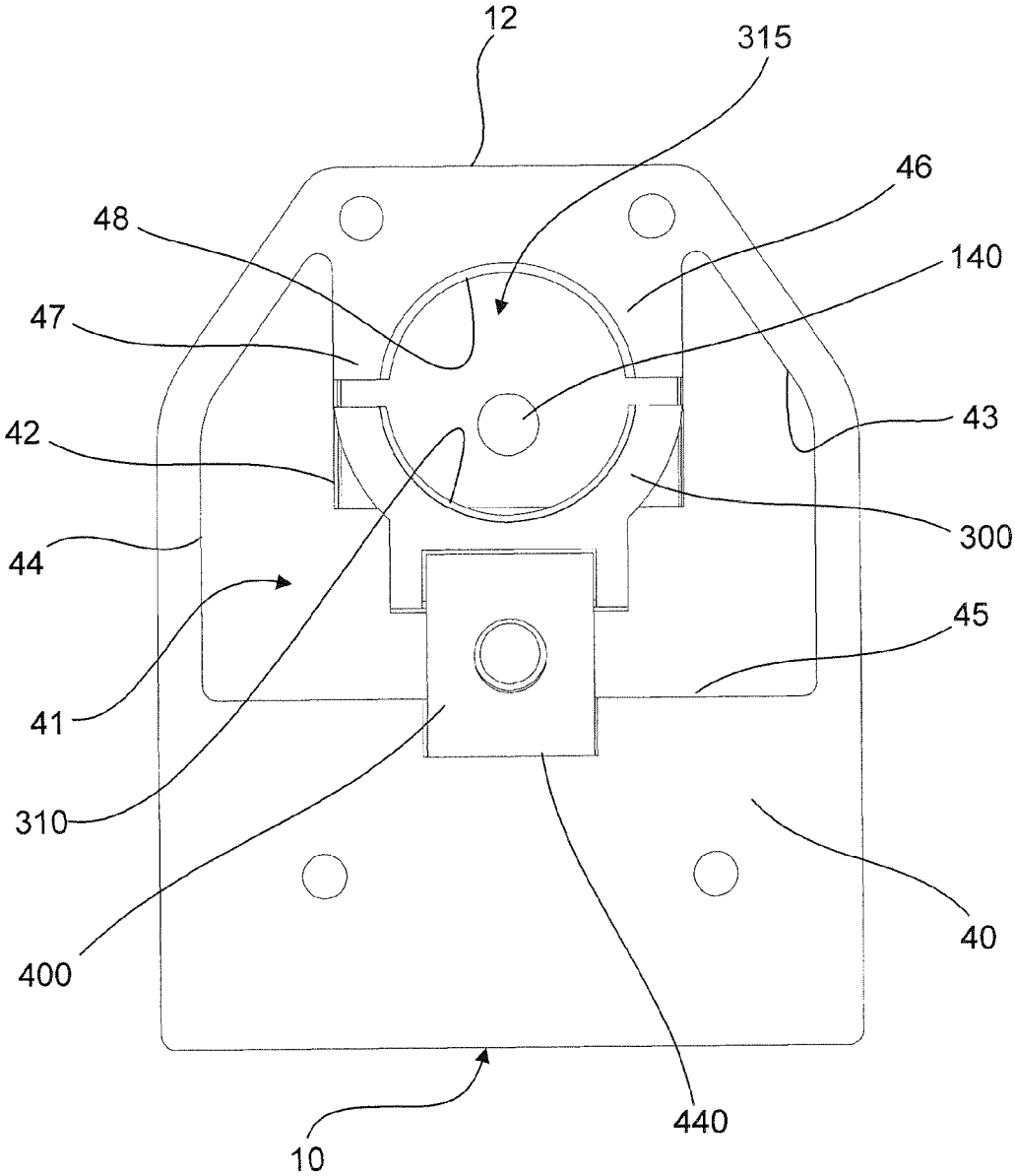
FIG. 4 is a bottom view of the battery clamp assembly, in accordance with aspects of the present invention.
Figure 5:
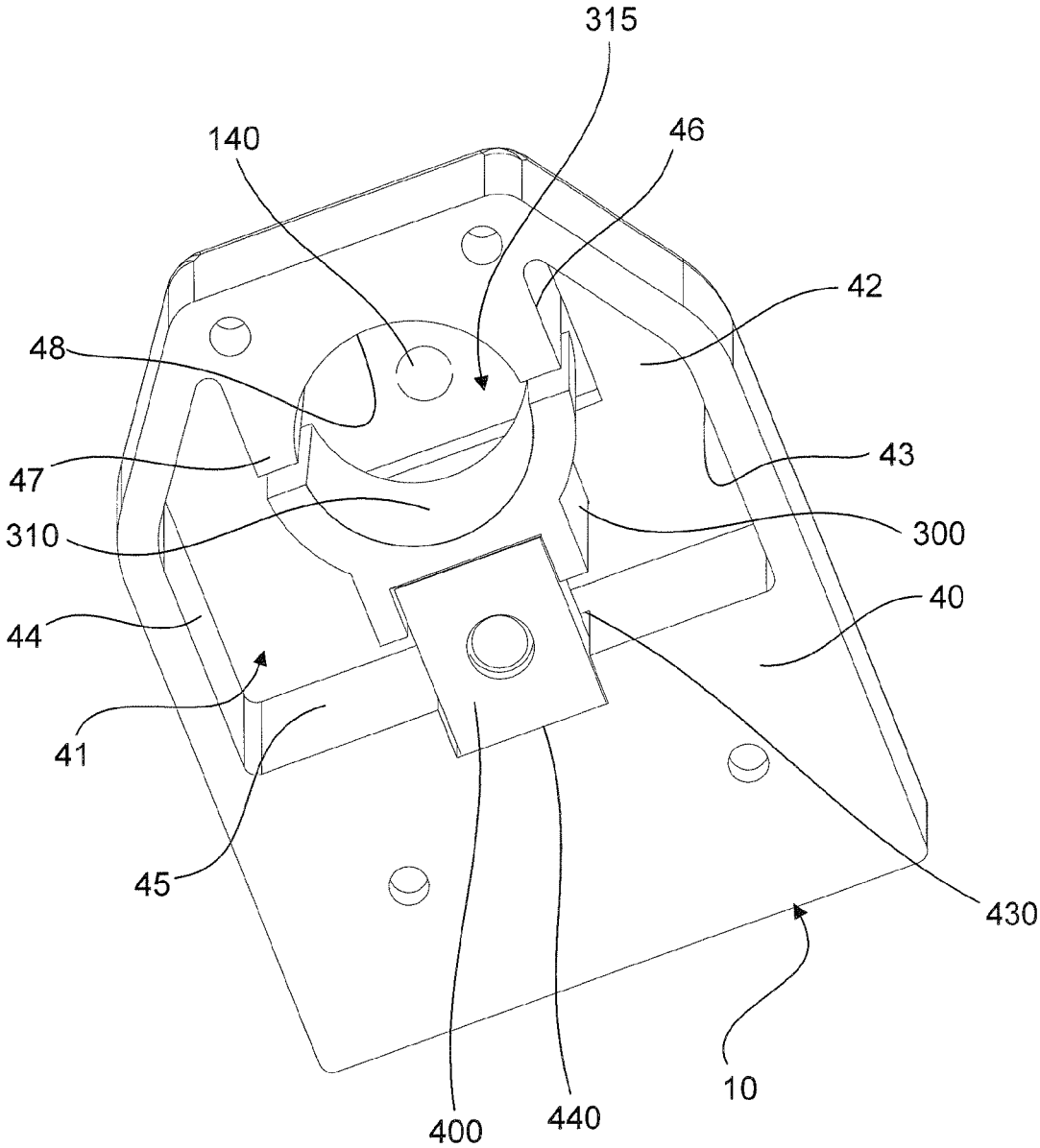
FIG. 5 is a bottom perspective view of the battery clamp assembly, in accordance with aspects of the present invention.

FIGS. 4 and 5 show a plan view and a perspective view of the lower surface 40 of the body 10. A clamp cavity 41 may be formed in the body 10 that is open at the lower surface 40 and extends into an interior of the body 10. The clamp cavity 41 may be bounded by an upper plate flange 42, cavity side walls 43 and 44, a rear wall 45 and a semicircular clamp mount 46. The semicircular clamp mount 46 extends into the clamp cavity 41 with prongs 47 extending away from the terminal end surface 12 joined together by an interior semicircular clamping surface 48. A floating c-clamp 300 is formed with a matching semicircular portion 310 that aligns opposite the semicircular clamp mount 46 in the clamp cavity 41 to form a clamping cylinder 315. A wedge groove 440 may be provided in the rear wall 45 of the clamp cavity 41. The wedge groove 440 may be formed to extend from the lower surface 40 of the body 10 to a shelf 430. The wedge groove 440 may slidably accommodate a compression wedge 400 with minimal clearance.

Figure 6:
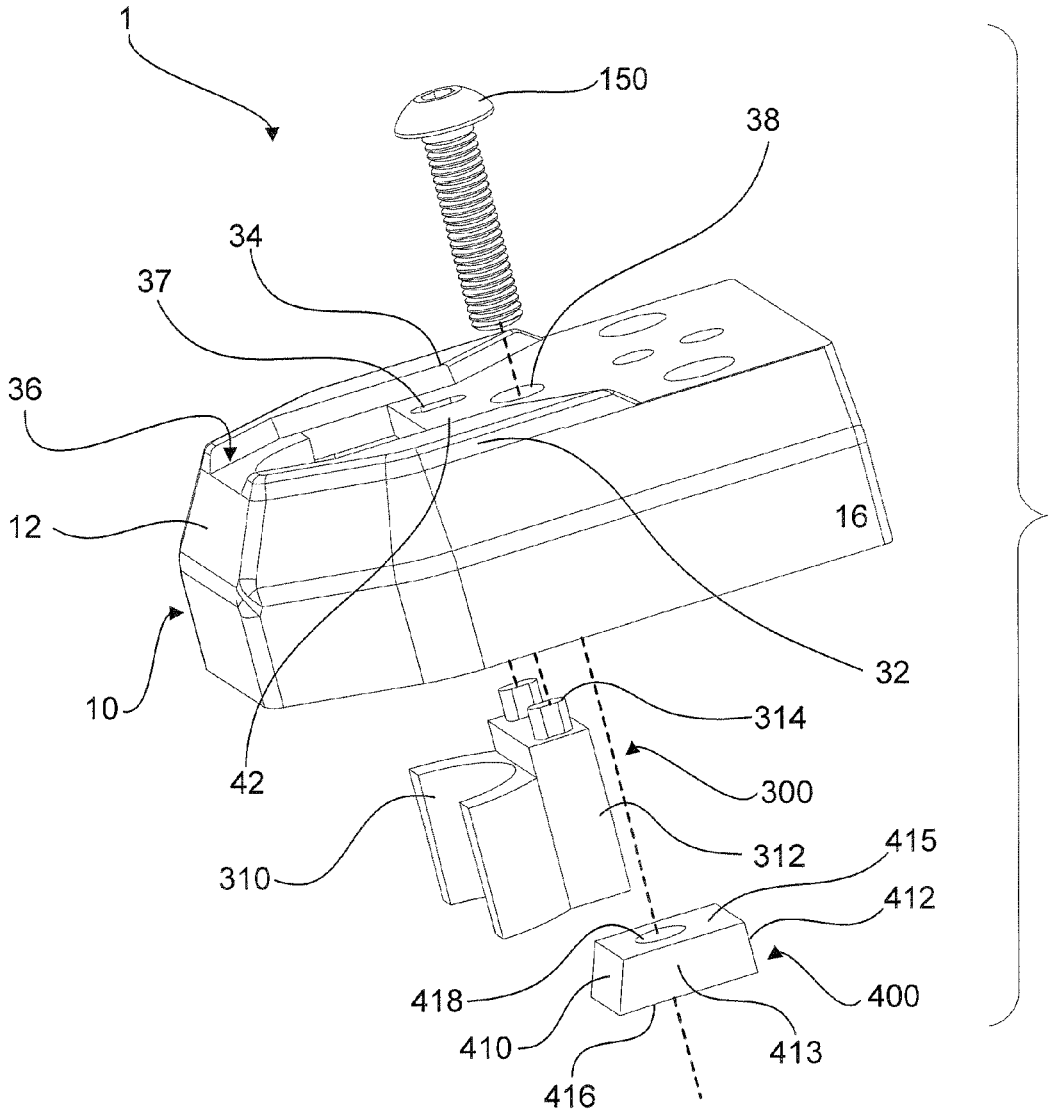
FIG. 6 is an exploded view of the battery clamp assembly, in accordance with aspects of the present invention.
Figure 7:
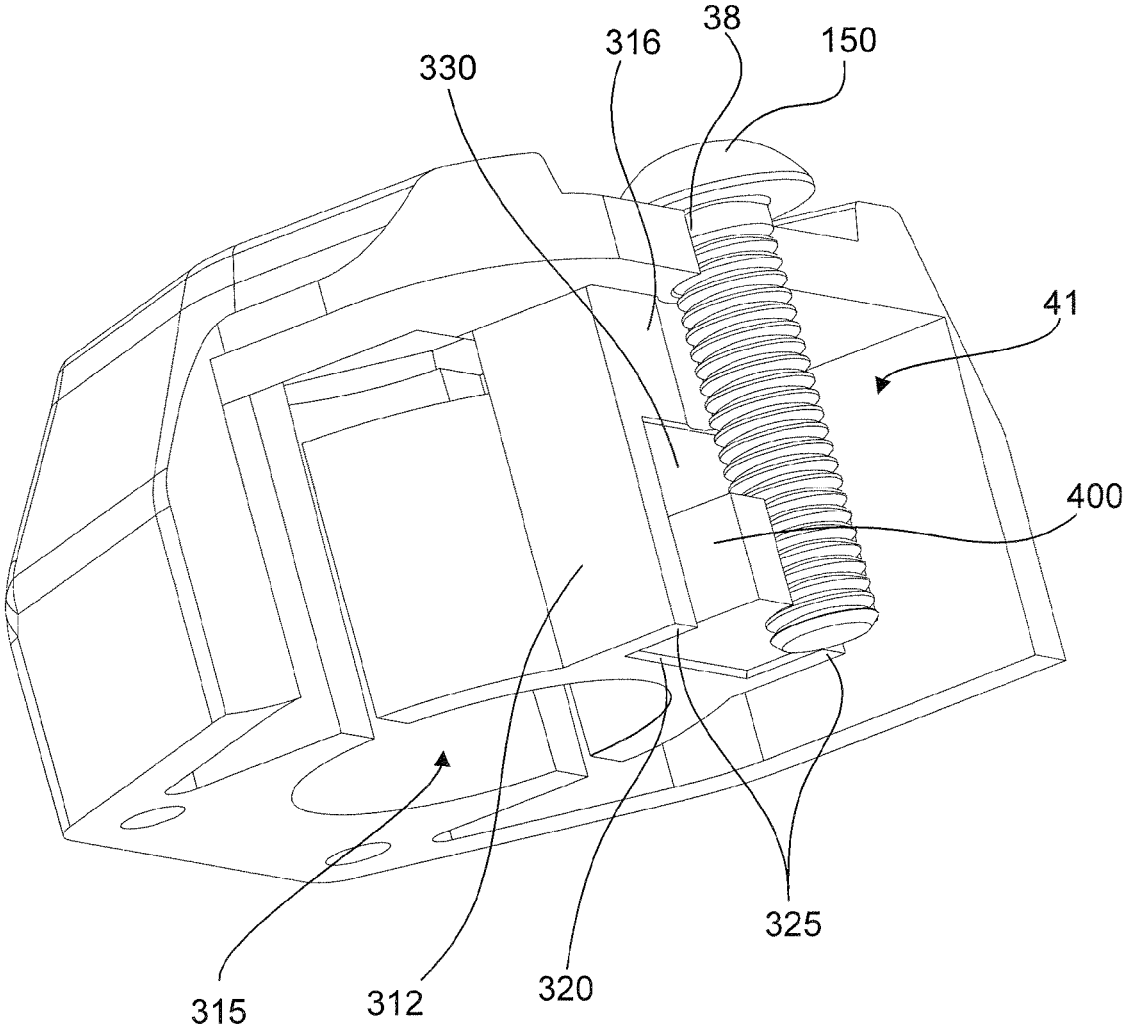
FIG. 7 is a cutaway bottom view of the battery clamp assembly taken along line A-A in FIG. 3, in accordance with aspects of the present invention.
Figure 8:
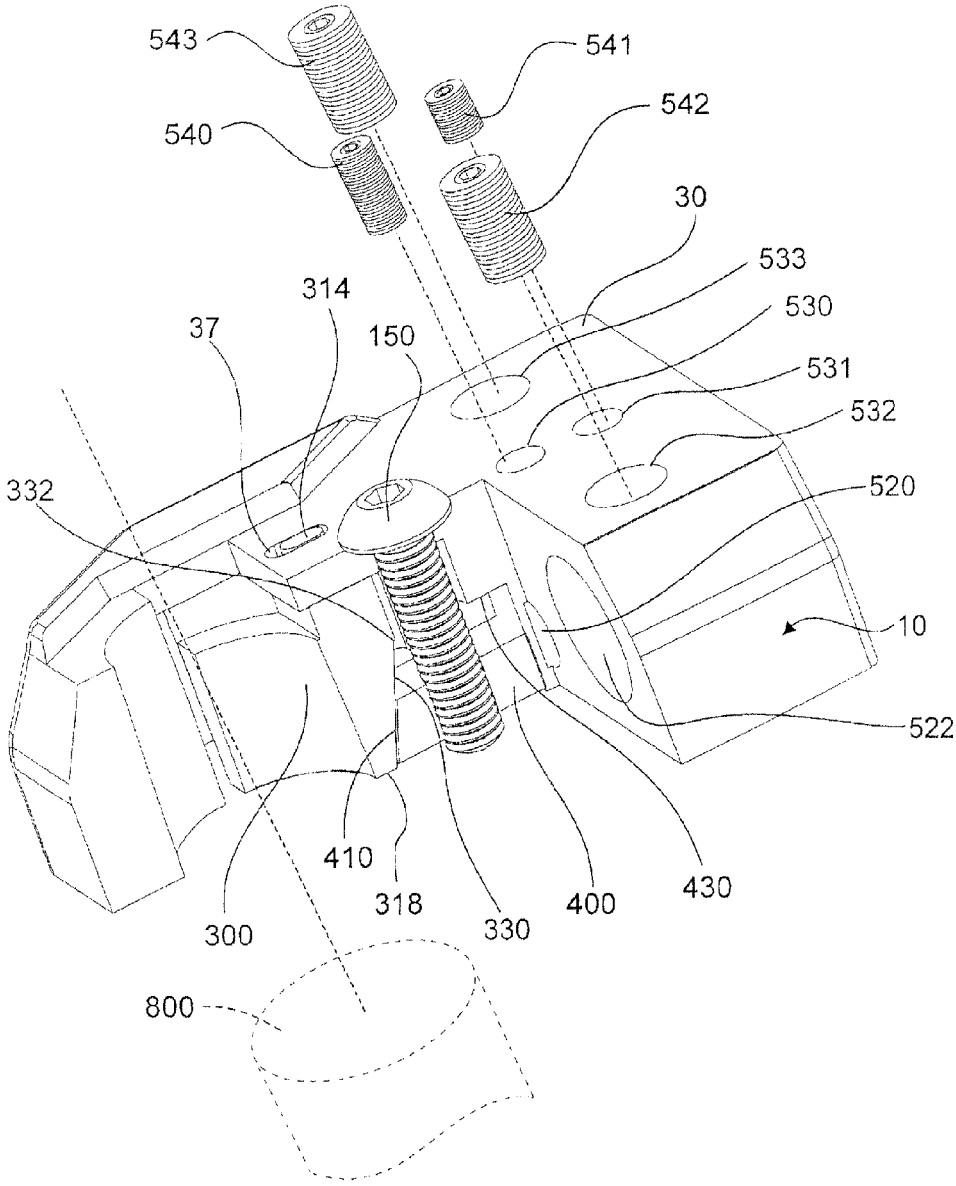
FIG. 8 is a cutaway top view of the battery clamp assembly taken along line B-B in FIG. 3, in accordance with aspects of the present invention.

As shown in FIG. 6, the floating c-clamp 300 may be formed with the semicircular portion 310 extending from a parallelepiped shaped clamp body 312. Two mounting posts 314 may extend from an upper surface of the clamp body 312 for coupling the c-clamp 300 to the body 10. As shown in FIG. 7, a rear surface 316 of the clamp body 312 has a wedge channel 320 that is formed by two side rails 325 and a compression surface 330. As shown in FIG. 8, the compression surface 330 slopes from an upper channel retaining lip 332 to a lower surface 318 of the clamp body 312 so that the wedge channel 320 is deepest at a lower surface 318 of the clamp body 312.

FIG. 6 also illustrates a compression wedge 400 in accordance with aspects of the present invention, which may be formed to be a right prism with a sloped wedge surface 410 and a rear wedge surface 412 connected by wedge sides 413, a wedge upper surface 415 and a wedge lower surface 416. An internally threaded wedge fastening aperture 418 may extend through the compression wedge 400 from the wedge upper surface 414 to the wedge lower surface 416.

FIGS. 6-8 illustrate the manner in which the floating c-clamp 300 and the compression wedge 400 may be sequentially mounted into the body 10 of the battery clamp assembly 1. The floating c-clamp 300 may be positioned into the clamp cavity 41 so that the mounting posts 314 slidably seat in post mounting slots 37 that extend through the upper plate flange 42. The compression wedge 400 may be inserted into the clamp cavity 41 below the floating c-clamp 300 so that the sloped wedge surface 410 slidably mates with the compression surface 330 and the rear wedge surface 412 slidably mates with a rear surface of the wedge groove 440. Thus, the floating c-clamp 300 may be vertically secured between the upper plate flange 42 and the compression wedge 400, and the compression wedge 400 may be horizontally secured between the floating c-clamp 300 and the wedge groove 440. A lower protective cover (not shown), made of any suitable, insulating material, such as a durable polycarbonate, may be attached to the lower surface 40 of the body 10 to seal the clamp cavity 41, for example. The lower protective cover may additionally be formed with at least one securing feature, such as a slot, notch, or a tab, for mating with an upper protective cover in order to provide a full protective enclosure around a substantial portion of the battery clamp assembly 1.

As shown in FIGS. 6-8, with or without the access cover 100 in place, the fastening device 150 may be coupled to the compression wedge 400 by inserting the fastening device 150 through the body fastening aperture 38 in the upper plate flange 42. The fastening device 150 may couple to the compression wedge 400 via the threaded wedge fastening aperture 418, for example. As shown in FIG. 8, tightening the fastening device 150 by a clockwise turning motion, for example, engages the threads in the compression wedge 400. The compression wedge 400 is prevented from twisting by the wedge groove 440 and the compression surface 330 of the floating c-clamp. At a point during tightening, when the fastening device 150 engages one of the upper surface 30 of the body 10 or the retaining flange 132 in the access cover 100, for example, continued tightening of the fastening device 150 will cause the compression wedge 400 to move in an upward vertical motion. As shown in FIG. 8, the upward vertical motion of the compression wedge 400 may be translated into a horizontal longitudinal motion of the floating c-clamp 300 by the sloped wedge surface 410 of the compression wedge 400 compressing against the sloped compression surface 330 of the floating c-clamp 300. As described previously, the floating c-clamp 300 is prevented from moving in the vertical direction by the combination of the upper plate flange 42 from above and the compression wedge 400 from below. The horizontal longitudinal movement of the floating c-clamp 300 may be limited by the dimensions of the post mounting slots 37 of the floating c-clamp 300 and/or by limiting the upward vertical motion of the compression wedge 400 through the formation and placement of the retaining lip 332 and/or the wedge groove shelf 430.

As described above, the battery clamp assembly 1 may be easily coupled to, or decoupled from, a battery terminal post 800, for example, by tightening or loosening the fastening device 150 with a wrench or screwdriver, for example. Tightening or loosening the fastening device 150 raises or lowers the compression wedge 400, forcing the floating c-clamp 300 to slide longitudinally back and forth, which constricts or expands, respectively, the clamping cylinder 315. When the c-clamp 300 is tightened, for example, the clamping cylinder 315 constricts and provides a tight, secure connection around a periphery of the battery terminal post 800 to ensure maximum delivery of current, for example, through the battery clamp assembly 1. To further enhance the integrity of the electrical circuit, the battery clamp assembly 1 and/or individual components thereof, may be forged from highly conductive material, including zinc or a zinc alloy such as brass, for example, which may also be plated with a suitable material such as nickel, brass or a chrome finish, for example, to provide corrosion resistance. Moreover, although described herein as comprising a floating c-clamp 300 and a semicircular clamp mount 46 that engage in the clamp cavity 41 to form a clamping cylinder 315, the battery clamp assembly 1 may be configured with any suitable engaging members (i.e., floating clamp and clamp mount) that combine to provide a secure connection around a periphery of the battery terminal post 800. As such, the dimensional aspects of the floating clamp and clamp mount may be varied infinitely, in accordance with aspects of the present invention.

In accordance with another aspect of the present invention, a terminal adapter (not shown), such as a gapped compressible cylinder, may be used in combination with the clamping cylinder 315. By concentrically positioning the terminal adapter inside of the clamping cylinder 315, the terminal adapter may further reduce an inner diameter of the clamping cylinder 315 during engagement of the battery clamp assembly 1 in order to ensure a tight connection when used with variably dimensioned terminal posts, for example.

Figure 9:
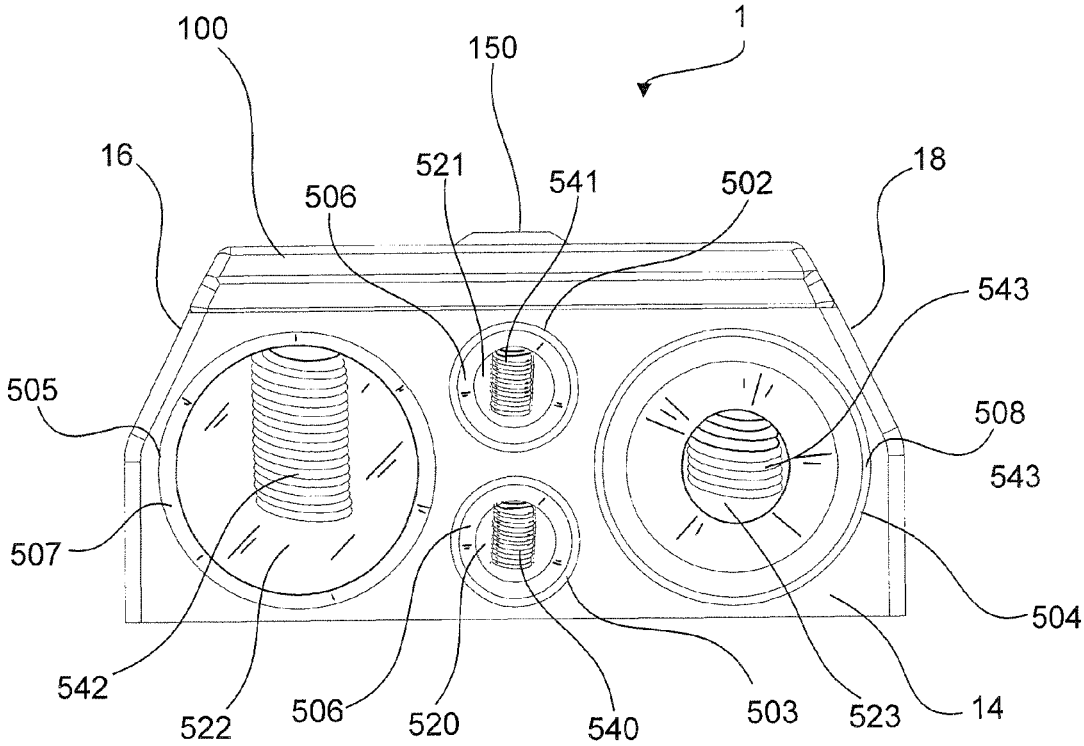
FIG. 9 is a rear view of the battery clamp assembly, in accordance with aspects of the present invention.

As shown in FIG. 8, connection portals 530, 531, 532 and 533 may be provided in the upper surface 30 of the body 10. The connection portals 530, 531, 532 and 533 provide access to individual and separate connection sockets 520, 521, 522 and 523, respectively. The connection portals 530, 531, 532 and 533 may be internally threaded to mate with externally threaded compression screws 540, 541, 542 and 543, for example, which may be metal screws with a flat hex head. As shown in FIG. 9, the externally threaded compression screws 540, 541, 542 and 543 may be screwed into the connection portals 530, 531, 532 and 533 so as to extend into each of the connection sockets 520, 521, 522 and 523, respectively.

Each separate connection chamber 520, 521, 522 and 523 may be bored, for example, an appropriate longitudinal depth into the body 10 from the insertion end surface 14 to provide access for the compression screws 540, 541, 542 and 543 through the connection portals 530, 531, 532 and 533. As shown in FIGS. 8 and 9, the connection chamber 520 may be provided below the connection chamber 521 and bored to a greater longitudinal depth into the body 10 from the insertion end surface 14. Accordingly, the connection portal 530 is deeper than the connection portal 531 in order to provide access to the connection chamber 520 provided below the connection chamber 521, and the compression screw 540 is longer than the connection screw 541 in order to screw into the deeper connection portal 530 and extend into the connection chamber 520 provided below the connection chamber 521.

FIG. 9 is a rear view of the batter clamp assembly 1. The insertion end surface 14 of the body 10 may have cable outputs 502, 503, 504 and 505 for providing connection of multiple gauge power cables to the battery clamp assembly 1. For example, as shown in FIG. 9, the two small cable outputs, 502 and 503, may be provided to accommodate smaller gauge connections, such 8 American wire gauge (AWG) cables, and the two large cable outputs 504 and 505, may be provided for larger gauge connections, such as 0 or 4 AWG cables. The small cable outputs, 502 and 503, and the large cable outputs, 504 and 505, may be formed with easy insert profiles that act as funnels to easily guide insertion of an appropriate wire into an appropriate connection socket 520, 521, 522 and 523 (see FIG. 8 for illustration of 520 and 522). For example, an internally sloping surface 506 may be provided in the small cable outputs 502 and 503 and/or an internally sloping surface 508, as shown with respect to large cable output 504 in FIG. 9, may be provided in the large cable outputs 504 and 505 to connect a larger diameter opening at or near the insertion end surface 14 and a smaller diameter opening more towards the interior of the body 10 that provides access to the connection sockets 520, 521, 522 and 523.

Figure 10:
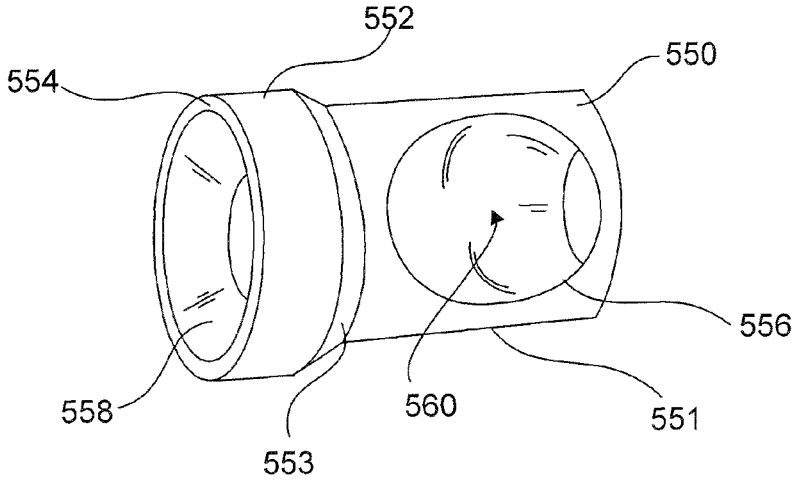
FIG. 10 is a perspective view of an insert to be used with the battery clamp assembly, in accordance with aspects of the present invention.

In accordance with another aspect of the present invention, a separately formed insert 550, as shown in FIG. 10, may be formed to slidably fit into one or more of the connection sockets 520, 521, 522 and 523. As shown with respect to the large cable output 505 in FIG. 9, when the insert 550 is removed, a much larger cable (i.e., lower gauge) may be inserted into the connection chamber 522.

FIG. 10 illustrates that the insert 550 may be formed with a cylindrical main body 551, for example, and a cylindrical insert portion 552 joined through a sloped step region 553. The cylindrical insert portion 552 may have a greater outer diameter than an outer diameter of the cylindrical main body 551, and include a sloping surface 558 extending concentrically and longitudinally inward from a distal end 554 toward an insert connection socket 560. When the insert 550 is slidably inserted into the body 10, the stepped region 552 abuts a shelf 507 (see FIG. 9) that is provided a predetermined longitudinal distance into the large cable output 505 from the insertion end surface 14. The stepped region 552 may thus seat against the shelf 507 so that the distal end 554 of the insert 550 is flush with the insertion end surface 14 and an insert portal 556 may easily align with the connection portal 532. The insert portal 556 thus provides access to the insert connection socket 560 for the compression screw 542, for example, when the insert 550 is slidably inserted through the insertion end surface 14 and into the connection socket 522. In accordance with yet another aspect of the present invention, the insert portal 556 may be sized to mate with the external threads of the compression screw 542 as the compression screw 542 is screwed into the connection portal 532 to additionally secure the insert 550 into the connection socket 522.

To use the battery clamp assembly 1, the access cover 100 is removed by unfastening the fastening device 150. A hex wrench or a hex key, for example, may be used to loosen the fastening device 150 and disengage the fastening device 150 from the compression wedge 400. Removal of the access cover 100 permits access to the compression screws 540, 541, 542 and 54.

Positive or ground cables for one or more components, such as a starter, solenoid, alternator, and/or audio, video and navigational equipment, may be connected to the battery clamp assembly 1, as appropriate, depending on whether the battery clamp assembly 1 is being coupled to the positive or negative terminal post of the battery. The appropriate externally threaded compression screws 540, 541, 542 and 543 may be loosened, depending on the number of components being powered and the associated gauge of the cable(s), so that the ends of the compression screws 540, 541, 542 and 543 do not extend completely through the respective connection sockets 520, 521, 522, 523, and/or 560 (in the case of use with the insert 550). The cables are inserted through the easy insert profiles of the cable outputs 502, 503, 504, 505 and/or the insert 550, and the compression screws 540, 541, 542 and/or 543 are tightened so that the cables are compressed and held securely within each of the connection sockets 520, 521, 522, 523, and/or 560.

With the component power cables thus connected, and the compression wedge 400 disengaged, the floating c-clamp 300 may slide longitudinally away from the clamp mount 46, expanding the clamping cylinder 315 to a diameter sufficient to fit onto a battery terminal post. The battery clamp assembly 1 may thus be coupled to a battery by sliding the clamping cylinder 315 around one of the battery terminal posts. As described above, a terminal adapter may be used to further reduce an inner diameter of the clamping cylinder 315, thus ensuring a tight connection of the battery clamp assembly 1 when used with a negative terminal post, for example, which often has a smaller post diameter. The keyed end 110 of the access cover 100 may be positioned into the keyed slot 36 of the upper surface 30 so that the cover fastening aperture 130 is aligned with the fastening aperture 38 in the body 10.

The fastening device 150 is inserted through the cover fastening aperture 130 and the fastening aperture 38 to couple with the compression wedge 400 by way of the wedge fastening aperture 418. As described previously, the fastening device 150 is tightened, which constricts the clamping cylinder 315 through the combined vertical motion of the compression cylinder 400 and horizontal motion of the c-clamp 300, providing a high integrity electrical connection of the battery clamp assembly 1 with the appropriate battery terminal post.

The appropriate polarity marker 144 may be plugged into the terminal aperture 140 to permit easy visual identification to which battery terminal post the battery clamp assembly 1 is coupled. The upper polycarbonate protective cover may be secured to the lower protective cover for additional protection of the electrical connections from the harsh environmental elements of a typical engine compartment.

Figure 11:
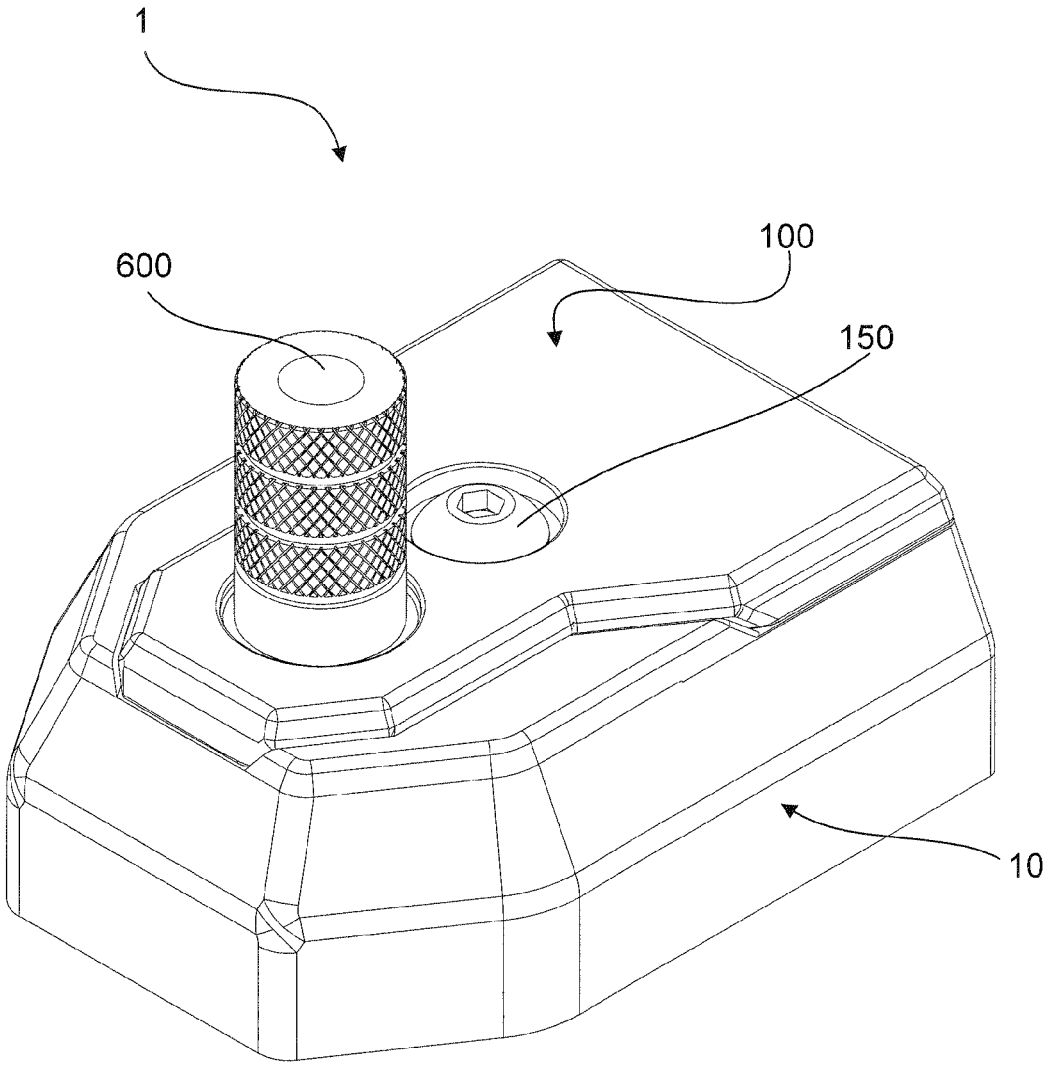
FIG. 11 is a perspective view of the battery clamp assembly with an attached lug, in accordance with aspects of the present invention.

As shown in FIG. 11, a jump start attachment 600 may provide access to a battery terminal post without the need to decouple the battery clamp assembly 1. The polarity marker 144 is first removed by simply unplugging the polarity marker 144 from the terminal aperture 140 in the access cover 100. The jump start attachment 600, which has an externally threaded lower post (not shown), may then be screwed into the terminal aperture 140 so that the lower post makes contact with an upper surface of the battery terminal post that is situated in the clamping cylinder 315 aligned below. Accordingly, an external battery clamp, for example, such as a jumper cable, may be attached to the extended jump start attachment to allow current from an external source to flow through the jump start attachment to the electrical system to which the battery clamp assembly 1 is connected. Particularly, when the battery clamp assembly has a special, plated finish, as is often the case when used in connection with after-market vehicle customization, for example, where aesthetics is the primary concern, the jump start attachment provides an ability to clamp an external device, such as a jumper cable, directly to a battery terminal without damaging the plated finish and ruining the cosmetics of the battery clamp assembly.

The various aspects of this disclosure are provided to enable one of ordinary skill in the art to practice the present invention. Modifications to various aspects of a battery clamp assembly presented throughout this disclosure will be readily apparent to those skilled in the art, and the concepts disclosed herein may be extended to other applications. Thus, the claims are not intended to be limited to the various aspects of a battery clamp assembly presented throughout this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A battery clamp assembly for connecting an electrical wire to a battery terminal, comprising:

a body having a clamp cavity and at least one connection socket for receiving the electrical wire;

a floating clamp positioned in the clamp cavity, wherein the floating clamp comprises a mounting post;

an upper flange plate comprising a post mounting slot, wherein the post mounting slot seats the mounting post of the floating clamp to restrict the horizontal movement of the floating clamp;

a compression wedge positioned in the clamp cavity; and a fastening member that engages the compression wedge to couple the floating clamp and the compression wedge to the body.

2. The battery clamp assembly of claim 1, wherein the body further comprises a clamp mount, the clamp mount extending into the clamp cavity and aligning with the floating clamp to form a clamping cylinder.

3. The battery clamp assembly of claim 1, wherein a vertical movement of the compression wedge translates into a horizontal movement of the floating clamp.

4. The battery clamp assembly of claim 1, further comprising an access cover having a terminal aperture, and wherein the body further comprises an upper surface, the access cover slidably mating to the upper surface of the body.

5. The battery clamp assembly of claim 4, wherein the upper surface further comprises left and right contoured shelves, the left and right contoured shelves protruding from the upper surface to form a keyed slot, and the access cover further comprises a keyed end, and wherein the keyed end of the access cover slidably seats in the keyed slot.

6. The battery clamp assembly of claim 5, wherein the upper surface further comprises a body fastening aperture and the access cover further comprises a cover fastening aperture, and wherein the body fastening aperture and the cover fastening aperture align when the keyed end of the access cover slidably seats in the keyed slot.

7. The battery clamp assembly of claim 4, further comprising a polarity marker, wherein the polarity marker slidably inserts into the terminal aperture.

8. The battery clamp assembly of claim 1, further comprising an insert slidably mounted into the at least one connection socket, wherein the insert reduces a size of the connection socket for receiving the electrical wire.

9. The battery clamp assembly of claim 1, further comprising a protective cover.

10. The battery clamp assembly of claim 4, further comprising a jump start attachment, wherein the jump start attachment connects directly to the battery terminal through the terminal aperture.

11. The battery clamp assembly of claim 1, further comprising a compression screw, wherein the compression screw extends through the body into the connection socket for securing the electrical wire to the battery clamp assembly.

12. The battery clamp assembly of claim 1, wherein the body further comprises a connection socket for coupling the electrical wire to the battery terminal.

13. The battery clamp assembly of claim 12, further comprising a compression screw, wherein the compression screw extends through the body into the connection socket for securing the electrical wire to the battery clamp assembly.

14. A method of completing an electrical circuit between a component and a power source, comprising:

coupling a battery clamp assembly to the power source, wherein the battery clamp assembly includes:

a body having a clamp cavity and at least one connection socket for receiving an electrical wire from the component;

an access cover having a fastening aperture, wherein the access cover is coupled to the body of the battery clamp assembly by extending the fastening member through the access cover;

a clamp positioned in the clamp cavity;

a compression wedge positioned in the clamp cavity;

a fastening member that engages the compression wedge to couple the clamp and the compression wedge to the body; and a compression screw extending through the body into the at least one connection socket;

connecting the electrical wire to the battery clamp assembly by securing the electrical wire into the at least one connection socket using the compression screw; and tightening the fastening member which engages the compression wedge to close the clamp and provide a secure electrical connection between the battery clamp assembly and the power source.

15. The method of completing an electrical circuit between a component and a power source of claim 14, wherein a vertical movement of the compression wedge translates into a horizontal movement of the clamp.

16. The method of completing an electrical circuit between a component and a power source of claim 14, further comprising the step of sliding an insert into the at least one connection socket, wherein the insert reduces a size of the connection socket for receiving the electrical wire.

17. A method of completing an electrical circuit between a power source and a battery terminal, comprising the steps of:

coupling a battery clamp assembly to the battery terminal, wherein the battery clamp assembly comprises an access cover comprising a fastening aperture;

mounting an attachment device to the battery clamp assembly, wherein the access cover is coupled to the body of the battery clamp assembly by extending the attachment device through the access cover, wherein the battery terminal is in direct contact with the attachment device; and electrically connecting the power source to the battery terminal through the attachment device.

* * * * *